United States Patent [19]

Elliott

[11] 4,407,261

[45] Oct. 4, 1983

[54] ARROW LOCK

[76] Inventor: Kenneth L. Elliott, 2101 W. Detroit, Chandler, Ariz. 85224

[21] Appl. No.: 334,447

[22] Filed: Dec. 24, 1981

[51] Int. Cl.[3] ..... F41B 5/00

[52] U.S. Cl. ..... 124/41 A; 124/DIG. 1

[58] Field of Search ..... 124/41 A, DIG. 1, 24 R, 124/86, 88, 80, 90, 35 H

[56] References Cited

U.S. PATENT DOCUMENTS

| | | | |
|---|---|---|---|
| 2,691,974 | 10/1954 | Nelson | 124/41 A |
| 3,158,145 | 11/1964 | Handy | 124/41 A |
| 3,504,659 | 4/1970 | Babington | 124/24 R |
| 4,038,960 | 8/1977 | Ludwig | 124/41 A |
| 4,318,390 | 3/1982 | Trotter | 124/41 A |

*Primary Examiner*—Richard C. Pinkham
*Assistant Examiner*—Scott L. Brown
*Attorney, Agent, or Firm*—Harry M. Weiss

[57] ABSTRACT

An arrow lock is provided which may be mounted on a compound bow to secure an arrow in the nocked position. First and second retaining flaps are rotatably coupled on a mounting plate. The retaining flaps have an adjacent edge into each of which a semicircular notch is cut thus defining a circular opening when the flaps are closed into which an arrow may be positioned. Biasing means are provided for biasing the flaps in the closed position. The flaps are coupled to the bow in such a manner that as the bow is drawn, the biasing means is overcome and the flaps snap open at some predetermined draw of the bow.

7 Claims, 6 Drawing Figures

FIG. 4
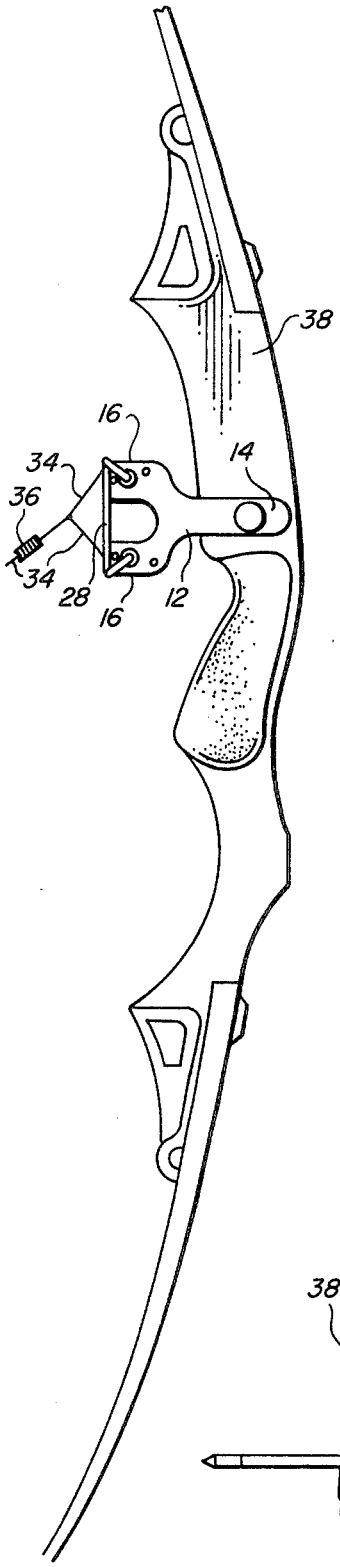
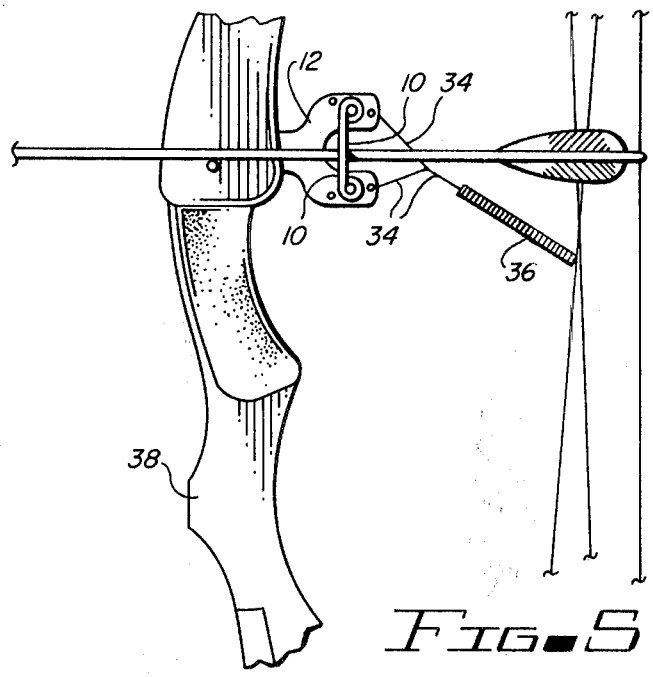
FIG. 5
FIG. 6
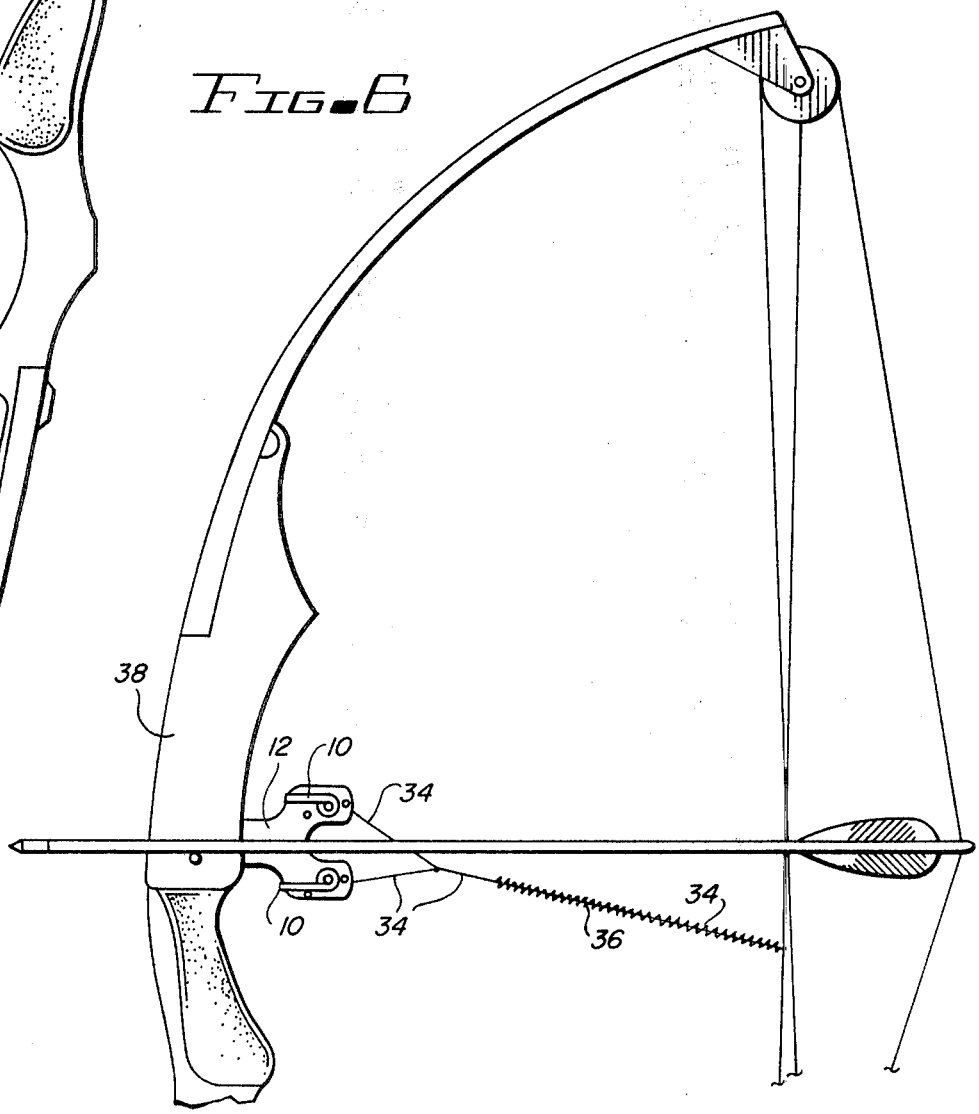

ARROW LOCK

BACKGROUND OF THE INVENTION

1. Field of the Invention

This invention relates generally to archery bows and, more particularly, to an arrow lock which may be mounted on a compound bow for securing an arrow in a nocked position.

2. Description of the Prior Art

Archery, for both sport and hunting, is becoming increasingly popular. Archers are well aware of the significant expense of arrows and the necessity of avoiding their damage. Furthermore, when hunting with a compound bow, it would be desirable to secure the arrow against disengagement when the bow is in a relaxed or nocked position to prevent the arrow from falling off its rest or rattling against the bow since either may startle game which is being stalked.

SUMMARY OF THE INVENTION

It is an object of this invention to provide an improved arrow lock.

It is a further object of the present invention to provide an arrow lock which secures the arrow against disengagement when the bow is in a relaxed or nocked position.

It is a still further object of the present invention that the improved arrow lock stabilize the arrow up to ¾ full draw.

According to a broad aspect of the invention, there is provided an arrow lock for mounting on a compound bow comprising a Y-shaped mounting plate having a mounting leg and first and second prong members; first and second shaft members protruding through said first and second prong members and mounted for rotation therein; first and second retaining flaps coupled to said first and second shaft members, respectively, each of said flaps having an adjacent edge into which a semicircular notch is cut to define a circular region which secures an arrow when said flaps are closed; first means coupled to said first and second shaft means for biasing said flaps closed; and second means coupled to said first and second shaft means for overcoming said biasing means when said bow is drawn causing said flaps to open and release said arrow.

The above and other objects, features and advantages of the present invention will be more clearly understood from the following detailed description taken in conjunction with the accompanying drawings, in which:

BRIEF DESCRIPTION OF THE DRAWINGS

FIG. 4 illustrates the inventive arrow lock mounted on a compound bow;

FIG. 5 illustrates the inventive arrow lock mounted on a compound bow and securing an arrow in the nocked position; and FIG. 6 illustrates the inventive arrow lock mounted on a compound bow in the full draw position.

THE SPECIFICATION

Figure 1:
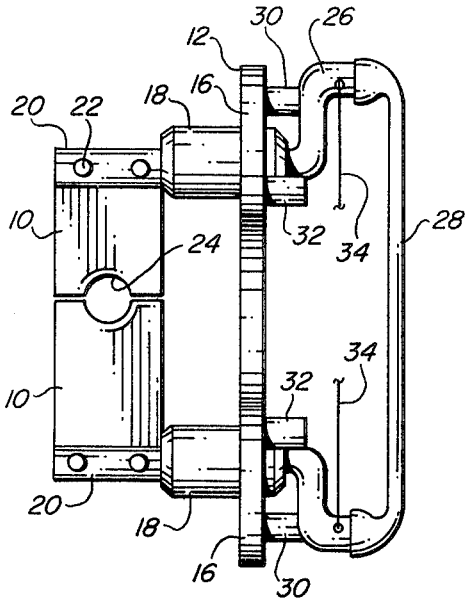
FIGS. 1, 2 and 3 are front, first-side and second-side views of the inventive arrow lock.
Figure 2:
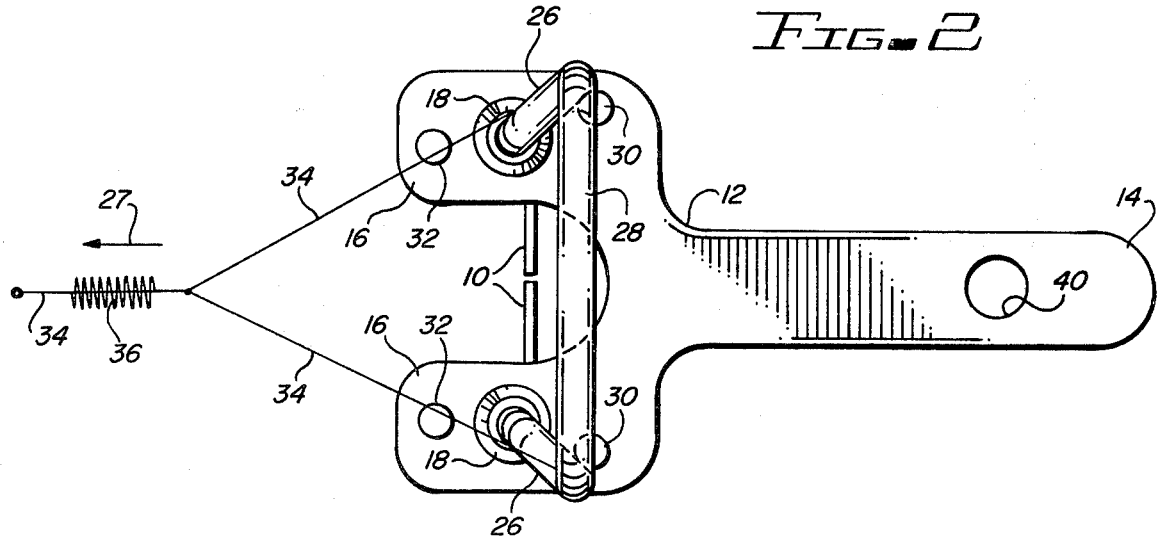
Figure 3:
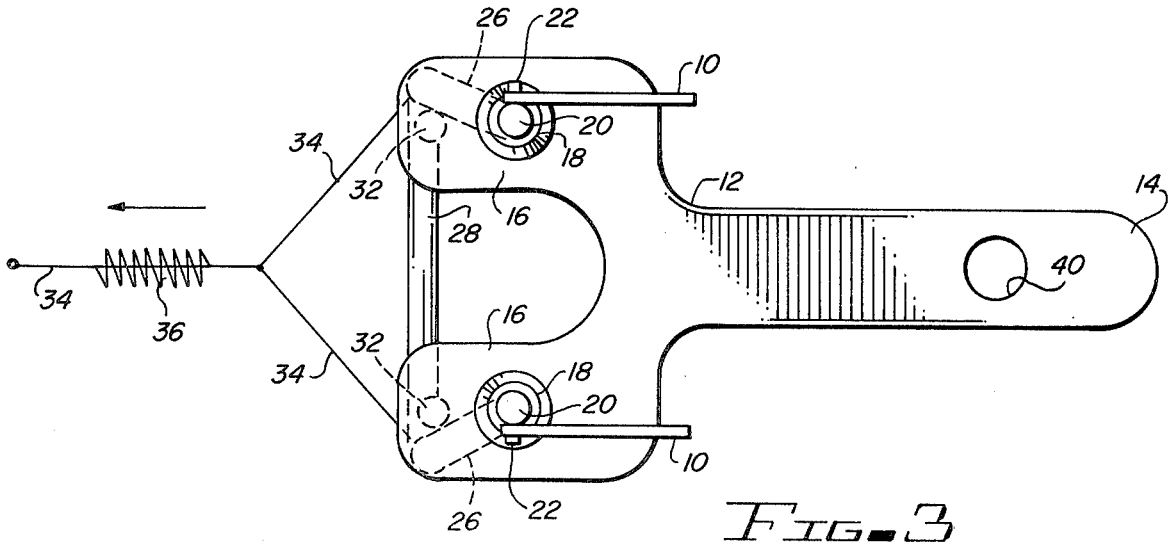

FIGS. 1, 2 and 3 are front, first-side and second-side views of the inventive arrow lock. In FIG. 2, retaining gates 10 are closed or in a retaining position while in FIG. 3 the retaining gates are open as will be more fully described below.

The inventive arrow lock consists of a Y-shaped plate 12 having a mounting leg 14 and first and second prong members 16. Positioned within each prong member is a sleeve 18 through which a rod like member 20 extends. Coupled to each rod like member 20, as for example by screws 22, is a retaining gate 10 each having a far edge into which a semicircular arc 24 is cut. Thus, when retaining gates 10 are closed, as is shown in FIG. 1, the shaft of an arrow may be secured within arcs 24.

Shaft 20 extends through sleeve 18 and is bent in an S-shape at 26. A piece of rubber or plastic tubing 28 is coupled to the ends of members 26 and acts as a spring so as to bias retaining gates 10 closed. It should be clear that any form of spring like member may be used to accomplish this purpose. Stop rests 30 and 32 are provided to define the boundaries of motion of S shape members 26 and shaft 20 within sleeve 18. As can be seen in FIG. 2, when the retaining gates 10 are closed, members 26 rest against stop rest 30.

When the closing force of resilient tube 28 is overcome by a force in the direction of arrow 27, retaining gates 10 will snap open as is shown in FIG. 3. To close the gates, the force provided by plastic or rubber tubing 28 must again be overcome in a reverse direction. FIGS. 2 and 3 show strings 34 coupled to members 26 and to a spring 36 and extending therethrough for reasons which will be discussed below. It is to be noted at this time that spring 36 in FIG. 2 has not been expanded indicating that no opening force is being placed on members 26. However, in FIG. 3, spring 36 is expanding indicating that a force is being exerted against members 26 which was sufficient to cause gates 10 to snap open.

FIG. 4 illustrates the inventive arrow locking device mounted on a compound bow 38. Mounting portions 14 of plate 12 is mounted on the backside of a sight window placing aperture 40 over the burger button. Additional mounting means such as screws or adhesives may be used to secure the arrow lock. The other end of spring 36 is then secured to the bow lines as shown. When the bow string is pulled back, string 34 which runs through spring 36 causes the closing force being exerted on members 26 by tube 28 to be overcome and the retaining gates 10 snap open at the ¾ draw point. The amount of force necessary to accomplish this, i.e. the amount of draw necessary, may be easily adjusted by adjusting the length of the string coupled between the ends of spring 36. If one gate should open before the other, the string may be moved in the direction of the gate which is open first. This can be continued until both gates open simultaneously.

FIG. 5 illustrates the inventive arrow lock actually holding an arrow in the nocked position. FIG. 6, on the other hand, illustrates the inventive arrow lock with its gates fully open as a result of pulling the bow to a full draw.

The above description is given by way of example only. Changes in form and details may be made by one skilled in the art without departing from the scope of the invention as defined by the appending claims.

What is claimed is:

1. An arrow lock for mounting on a compound bow, comprising:

a Y-shaped mounting plate having a mounting leg and first and second prong members;

first and second shaft members protruding through said first and second prong members and mounted for rotation therein;

first and second retaining flaps coupled to said first and second shaft members, respectively, each of said flaps having an adjacent edge into which a semicircular notch is cut to define a circular region which secures an arrow when said flaps are closed;

first means coupled to said first and second shaft means for biasing said flaps closed; and second means coupled to said first and second shaft means for overcoming said biasing means when said bow is drawn causing said flaps to open and release said arrow.

2. An arrow lock according to claim 1 wherein said first means comprises resilient tubing coupled to said first and second shaft means.

3. An arrow lock according to claim 2 further comprising stop means mounted on said plate for defining the open and closed positions of said flaps.

4. An arrow lock according to claim 3 wherein said mounting leg has a mounting aperture therein.

5. An arrow lock according to claim 4 wherein first and second sleeves are provided in said first and second prong members, respectively, through which said first and second shaft members extend.

6. An arrow lock according to claim 5 wherein said first means is coupled to said first and second shaft members on a first side of said mounting plate and said flaps are coupled to said first and second shaft members on a second side of said plate.

7. An arrow lock according to claim 1 wherein said first means comprises a spring coupled between said first and second shaft means.

* * * * *